US006866911B1

(12) United States Patent
DeMott et al.

(10) Patent No.: US 6,866,911 B1
(45) Date of Patent: Mar. 15, 2005

(54) PILE FABRIC HAVING CONDITIONED PILE ENDS

(75) Inventors: Roy P. DeMott, Spartanburg, SC (US); Louis Dischler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/542,205

(22) Filed: Apr. 4, 2000

(51) Int. Cl.[7] ..... B32B 33/00
(52) U.S. Cl. ..... 428/92; 428/91
(58) Field of Search ..... 428/92, 91; 26/2 R, 26/28, 28 R, 31, 36

(56) References Cited

U.S. PATENT DOCUMENTS

| | | | | | |
|---|---|---|---|---|---|
| 3,922,455 | A | * | 11/1975 | Brumlik | 428/85 |
| 4,259,393 | A | * | 3/1981 | Marco | 428/224 |
| 4,520,058 | A | * | 5/1985 | Okabe | 428/90 |
| 5,050,280 | A | * | 9/1991 | Hartkorn et al. | 26/28 |
| 5,459,911 | A | * | 10/1995 | Iwami | 26/28 |
| 5,943,745 | A | | 8/1999 | Dischler | 26/28 |
| 6,112,381 | A | * | 9/2000 | Dischler et al. | 26/28 |
| 6,122,807 | A | * | 9/2000 | Beltramini | 26/28 |
| 6,233,795 | B1 | * | 5/2001 | Dischler | 26/28 |

FOREIGN PATENT DOCUMENTS

| | | | | |
|---|---|---|---|---|
| EP | 381864 A1 | | 12/1989 | |
| EP | 784114 | * | 7/1997 | D06C/11/00 |
| EP | 0897032 | | 6/1998 | |
| WO | WO 97/14841 | * | 4/1997 | D06C/11/00 |

OTHER PUBLICATIONS

International Search Report for PCT/US 01/07562; European Patent Office, Aug. 14, 2001.

* cited by examiner

*Primary Examiner*—Cheryl A. Juska
(74) *Attorney, Agent, or Firm*—Terry T. Moyer; Jeffery E. Bacon

(57) ABSTRACT

A pile of a pile fabric is subjected to a forward abrasive action and a reverse abrasive action. The pile of the pile fabric obtains disturbances and/or fibrils on the ends of the piles.

14 Claims, 5 Drawing Sheets

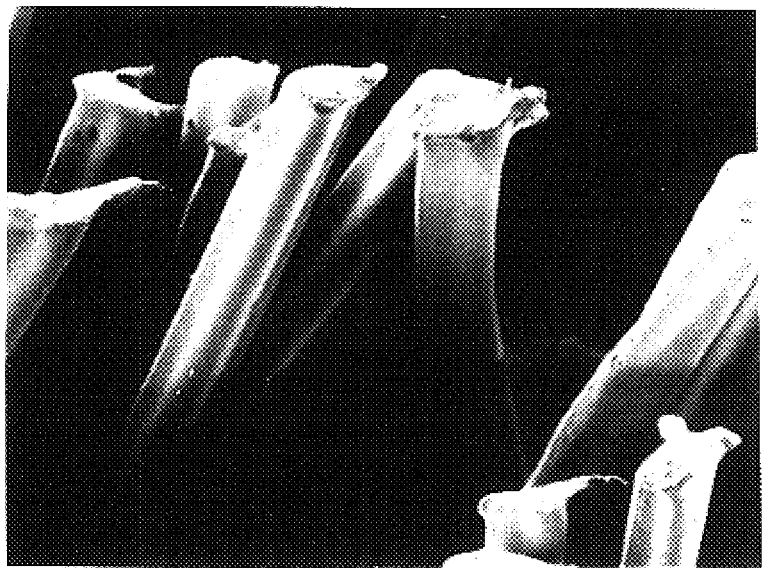
FIG. —9—
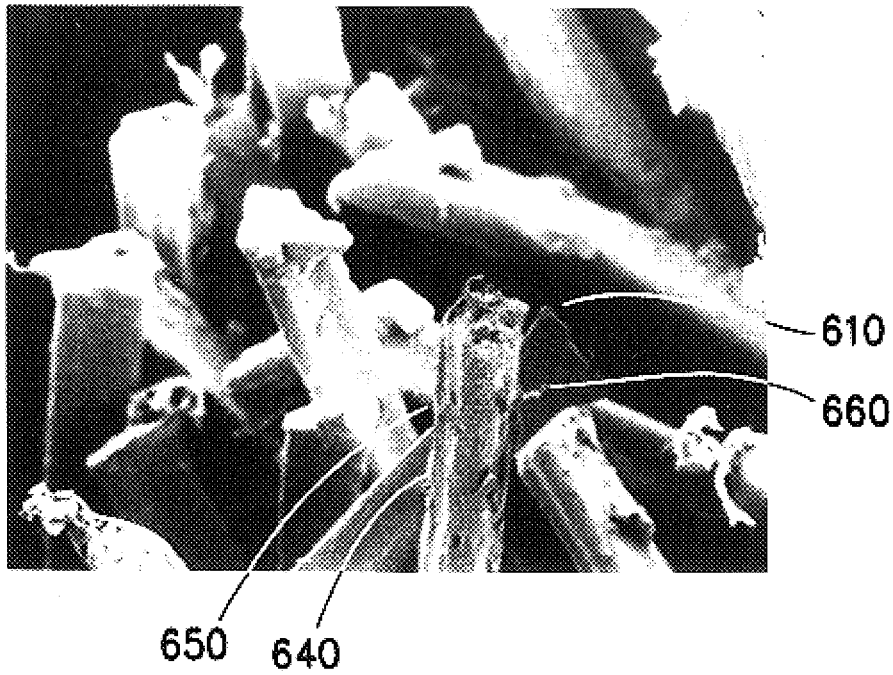
FIG. —10—

PILE FABRIC HAVING CONDITIONED PILE ENDS

BACKGROUND

The present invention is directed to fabrics, and in particular, to pile fabrics having treated pile.

In one method of producing pile fabrics, a double-knitted pile fabric is produced by knitting two separate fabrics face to face with float yarns interlaced between the two. A knife moves between the two fabrics severing the floats, which become cut pile of the pile fabrics. However, the ends of the pile for fabrics produced in this matter are typically disrupted to have an expanded cross-section. In some instances the expanded cross-section appears in a profile view as an anvil. In many instances, the anvil can angle back towards the direction of the pile fiber, producing a hook-like structure. Alternatively, a flat fabric may be napped and sheared, producing expanded fiber ends very similar to those of the slit knit pile. In either case, the pile has a substantially uniform length.

Materials such as fabrics are characterized by a wide variety of functional and aesthetic characteristics. Of those characteristics, a particularly important feature is fabric surface feel or "hand". The significance of a favorable hand in a fabric is described and explained in U.S. Pat. Nos. 4,918,795 and 4,837,902, both issued to Dischler, and both being incorporated in there entirety herein by specific reference thereto.

The expanded end of piles in the traditional pile fabrics provides a hand or surface feel that might have a "sticky" feel. Additionally, if "hooks" are created by the anvil on the end of the piles, the "hooks" can become entangled with materials that pass over the pile fabric, such as furs, or the like. Furthermore, the expanded pile ends, and anvils, of prior art pile can produce an appearance of a different color or hue when the pile is brushed in different directions. Therefore, there is a need for pile fabrics having ends of the pile which reduce these effects of common pile fabric to provide a better "hand" or feel of the fabric.

BRIEF DESCRIPTION OF THE DRAWINGS

The present invention can be described with regard to the accompanying drawings where:

FIG. 9 is an enlargement of the pile of a prior art fabric prior to treatment according to the process in FIG. 4;

FIG. 10 is an enlargement of the prior art fabric from FIG. 9 after processed according to the process in FIG. 9.

DETAILED DESCRIPTION

Figure 1:
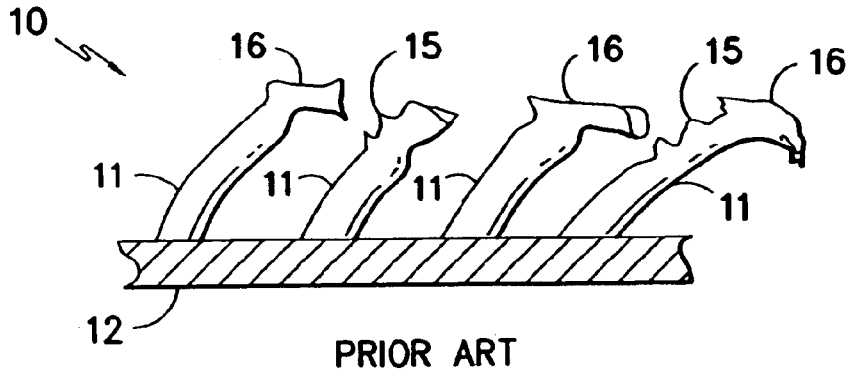
FIG. 1 is an illustration of a prior art pile fabric.

Referring now to the figures, and in particular to FIG. 1, there is illustrated a prior art pile fabric 10 with pile fibers 11, which has been produced by the traditional prior art method of severing the float yarn interlaced between two fabrics with a knife. The pile fibers 11 of the fabric 10 extend from a substrate 12. As illustrated in FIG. 1, the process of severing float yarns with a knife produces pile fibers 11 having a base section 13 and end zones 14. The end zones 14 include one-sided disturbances 15 and/or enlarged ends 16, typically being an anvil shape.

Figure 2:
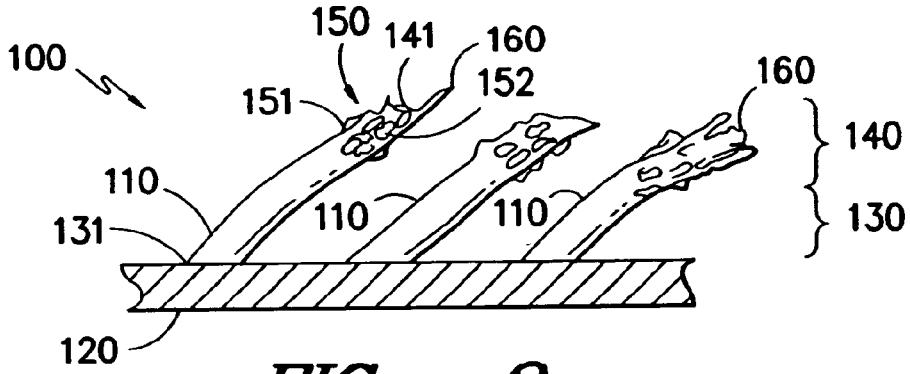
FIG. 2 is an illustration of an embodiment of the pile fabric of the present invention having end zones with disturbances and fibrils extending from the ends of the pile fiber.

Referring now to FIG. 2, there is illustrated a fabric 100 of one embodiment of the present invention having a face side with pile fibers 110. The pile fibers 110 of the fabric 100 extend from a substrate 120. In one embodiment, the pile fibers 110 are polyester. However, it is contemplated that the pile fibers 110 can be formed of any thermoplastic polymer. The pile fibers 110 are free end fibers that include a base section 130 and an end section 140. The base section 130 has a proximal end 131 disposed approximate to the substrate 120, and the end section 140 has a distal end 141 disposed opposite from the proximal end 131. The end section 140 includes disturbances 150 of flaking 151 and/or pitting 152 around a majority of the pile 110. However, it is preferred that the disturbances 150 of flaking 151 and/or pitting 152 be substantially around the circumference of the pile fiber 110, and even more preferred that the disturbances 150 be entirely around the circumference of the pile fiber 110. The disturbances 150 of the end section 140 extend down the pile fiber 110 a distance of at least about 2%, and no more than about 90%. In one embodiment, it is preferred that the disturbances 150 extend down the pile fiber at least about 5% and no more than about 50%. The end 141 of the pile fiber 110 has had a majority of the enlarged head removed, and fibrils 160 extend from the end 141 of the pile fiber 110.

Figure 3:
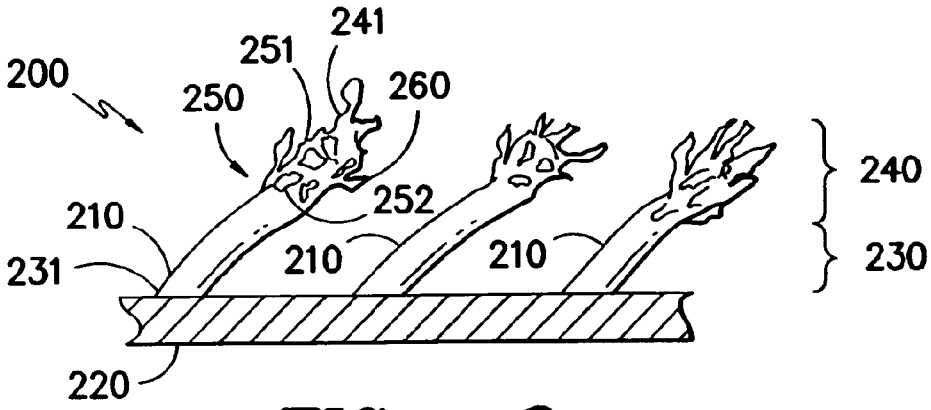
FIG. 3 is an illustration of an embodiment of the pile fabric of the present invention having end zones with disturbances and fibrils extending from the side walls and ends of the pile fiber.

Referring now to FIG. 3, there is illustrated a fabric 200 of one embodiment of th present invention having a face side with pile fibers 210. The pile fibers 210 of the fabric 200 extend from a substrate 220. In one embodiment, the pile fibers 210 are polyester. However, it is contemplated that the pile fibers 210 can be formed of any thermoplastic polymer. The pile fibers 210 are free end fibers that include a base section 230 and an end section 240. The base section 230 has a proximal end 231 disposed approximate to the substrate 220, and the end section 240 has a distal end 241 disposed opposite from the proximal end 231. The end section 240 includes disturbances 250 of flaking 251 and/or pitting 252 around outer circumference of the pile 210. As with the pile fiber 110 from FIG. 2, the disturbances 250 of flaking 251 and/or pitting 252 are around a majority of the pile fiber 210. However, it is preferred that the disturbances 250 be substantially around the circumference of the pile fiber 210, and even more preferred that the disturbances 250 be entirely around the circumference of the pile fiber 210. The disturbances 250 of the end section 240 extend down the pile fiber 210 a distance of at least about 2%, and no more than about 90%. In one embodiment, it is preferred that the disturbances 250 extend down the pile 210 fiber at least about 5%, and no more than about 50%. The end 241 of the pile fiber 210 has had the enlarged head removed, and fibrils 260 extend from the end 241 of the pile fiber 210 and from the side walls of the pile fiber 210 in the end section 240.

Figure 4:
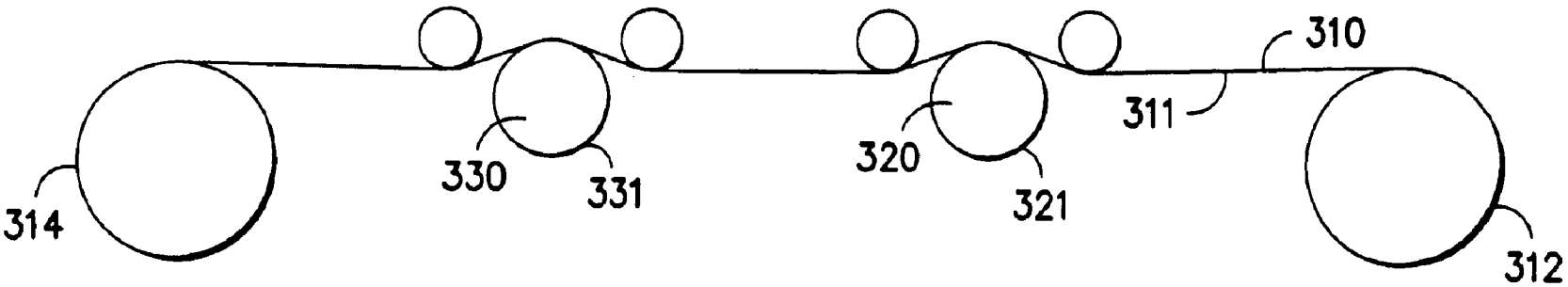
FIG. 4 shows a block diagram of a process according to the present invention for the treatment of pile.

Referring now to FIG. 4, there is shown a block diagram illustrating a process of the present invention for treating the pile of a pile fabric 310. The pile fabric 310 is subjected to the process of the present invention wherein the face side, or pile side, 311 of the fabric 310 is exposed to a high-pressure contact with a plurality of abrasive covered rollers 320 and 330. The contact pressure of the fabric 310 against the abrasive rollers 320, 330, is generated by controlling the tension of the fabric 310 over the abrasive rollers 320, 330, which is preferably greater than 2 pounds per linear inch. The diameter of the abrasive rollers 320, 330, is preferably 4.5 inches, and may range from 2 inches to 24 inches. The abrasive material covering th surface 321 and 331, respectively, of the abrasive rollers 320 and 330, is preferably a U.S. mesh size of 220 grit, or smaller, and most preferably of 400 grit. The grit should have a mohs' hardness of about 9 to about 10, with diamond grit being the most preferred. It is believed that angular sueding, as disclosed in U.S. Pat. No. 5,943,745, issued to Dischler et al., which is hereby incorporated in its entirety herein by specific reference to, may also be advantageously used by the process. However, any abrasion angle may be used.

Still referring to FIG. 4, the pile fabric 310 travels from a supply roll 312, over the abrasive rollers 320, 330, and to a take up roll 314. At least one of the abrasive rollers 320, 330, is rotated at a speed that results in the abrasive surface 321, 331, traveling at a speed greater than the pile fabric 310. The result of this greater speed is a forward abrasive action on the pile of the fabric 310. At least one of the abrasive rollers 320, 330, is rotated at a speed and direction that results in the abrasive surface 321, 331, of the coated roller 320, 330, traveling in a relative direction opposite to the flow of the pile fabric 310. The result of this relative opposite direction of the abrasive surface is a reverse abrasive action on the pile of the fabric 310. The forward and reverse abrasive action on the pile of the fabric 310 causes at least a majority of the circumference around the pile fibers to have disturbances and/or fibrils.

After the piles of the fabric are subjected to the abrasive action, the fabric can be dyed and finished. In one embodiment, the finish includes a coating of a chemical lubricant to improve the "handle" of the fabric. A preferred chemical lubricant includes a condensate of dimethyl terphthalate and high molecular weight polyethylene glycol. An example of a chemical lubricant that can be used in the present invention is Lubril QCX, from Abco Chemical, Roebuck, S.C. The chemical lubricant is applied in an aqueous solution with 16% solids. The aqueous solution is applied at a rate of from about 0.5% to about 5.0% of the weight of the fabric, and preferably about 1.5% of the weight of the fabric. The chemical lubricant retains moisture and acts as an antistat to aid in processing and post processing comfort. The chemical lubricant allows a hand to glide more easily across the pile of the fabric and give an additional softness to the touch of the fabric. One unexpected result of the present invention is the enhanced effect of the chemical lubricant finish when used on the pile fabric of the present invention. It is believed that the fibrils and disturbances of the present invention provide additional surface area for storage and contact of the chemical lubricant finish.

Figure 5:
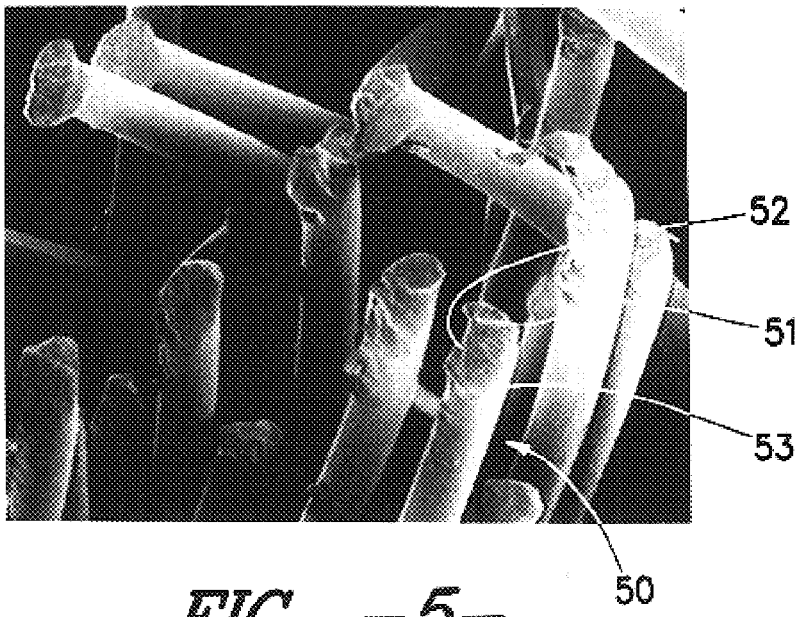
FIG. 5 is an enlargement of the pile of a prior art fabric prior to treatment according to the process in FIG. 4.

Referring now to FIG. 5, there is illustrated the pile 50 of a prior art fabric prior to treatment according to the process of the present invention. As shown in FIG. 5, the process of cutting the prior art pile creates heads 51 on the ends of many of the piles 50. The heads 51 are typically anvil shaped, many of which angle back sufficiently enough to form "hooks". The process of cutting the prior art pile 50 also creates disturbances 52 on a single side of the end zone 53 of the pile 50. It is believed that the disturbances 52 are created only on one side of the pile due to contact of the cutting blade just prior to cutting the pile 50.

Figure 6:
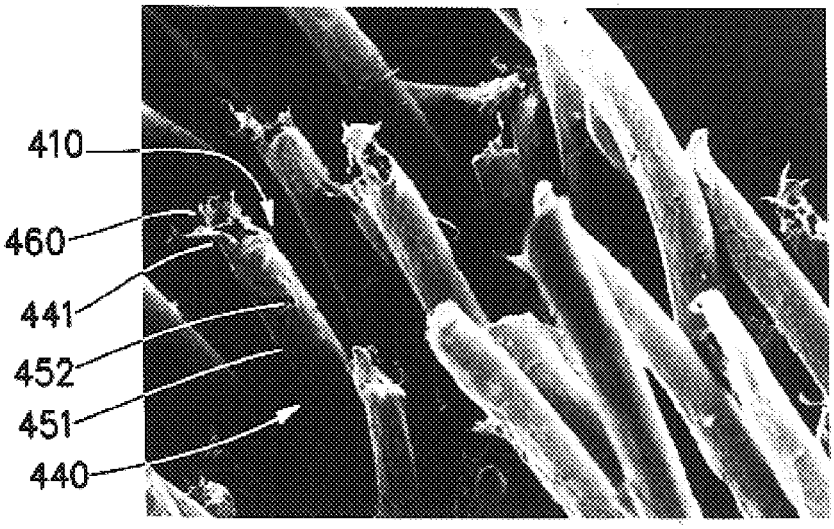
FIG. 6 is an enlargement of the prior art fabric from FIG. 5 after processed according to the process in FIG. 5.

Referring now to FIG. 6, there is illustrated pile of the fabric from FIG. 5, which has been subjected to the process of the present invention. The piles 410 of the treated pile fabric have free end fibers with end zones 440. The end zones 440 include disturbances 450 around a majority of the circumference of the pile 410. In most areas of the end zone 440 of the pile 410, the disturbances 450 are either substantially around the circumference of the pile 410, or entirely around the circumference. The disturbances 450 of the pile ends 440 include flaking 451 and pitting 452 of the pile surface. The disturbed zones of the piles 410 also include fibrils 460 extending from the pile 410. Although some fibrils 460 are located on the side walls of the piles 410, a majority of the fibrils 460 are located extending from the ends 441 of the piles 410. It is believed that a majority of the fibrils 460 are located on the ends 441 of the pile 410 because the enlarged heads of the prior art pile fabric are transformed more readily into the fibrils 460 by the process of the present invention.

Figure 7:
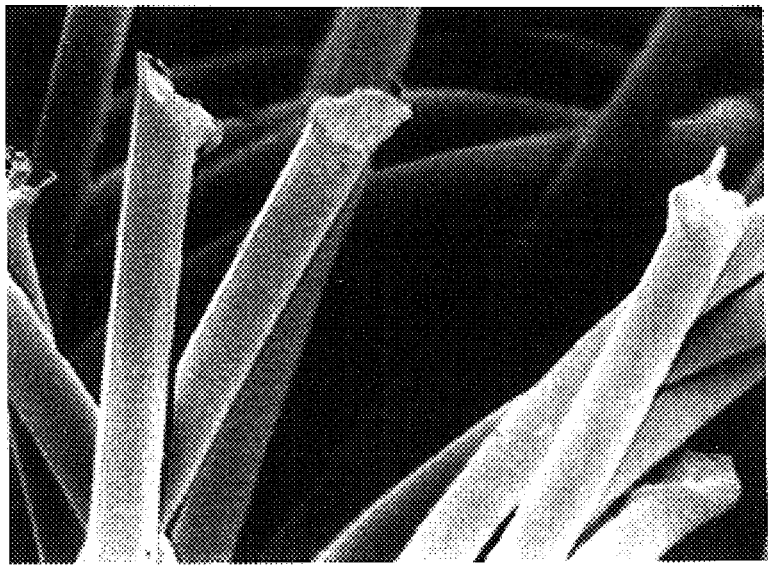
FIG. 7 is an enlargement of the pile of a prior art fabric prior to treatment according to the process in FIG. 4.
Figure 8:
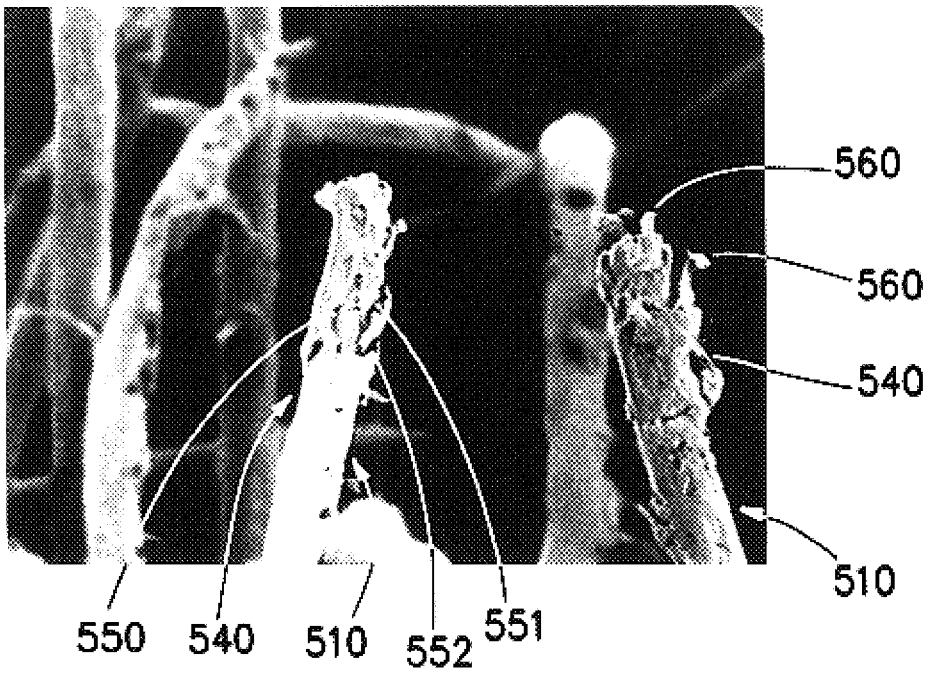
FIG. 8 is an enlargement of the prior art fabric from FIG. 7 after processed according to the process in FIG. 7.

Referring now to FIGS. 7 and 8, there is illustrated the pile of a fabric before and after, respectively, being subjected to the process of the present invention. The piles of the fabric in FIGS. 7 and 8 illustrate a greater amount of disturbances on the pile ends of the fabric. As shown in FIG. 8, the pile fibers 510 have a greater proportion of disturbances 550 of flaking 551 and pitting 552 of the pile end zones 540 than the pile 410 in FIG. 6. Additionally, the pile end zones 540 of the pile 510 in FIG. 8 have a greater amount of fibrils 560 extending from the side walls of the pile 510 than the pile end zones 440 of the piles 410 in FIG. 6.

Referring now FIGS. 9 and 10, respectively, there is illustrated the pile of a fabric before and after, respectively, being subjected to the process of the present invention, the cross section of the pile having a non-circular shape. A cross section of the pile in FIGS. 9 and 10 has three lobes extending from a central area. As illustrated in FIG. 10, the pile 610, after processing, has disturbances 650 around the cross section in the area of the end zone 640 of the pile 610, similar to the disturbances 450 and 550 in the piles of FIGS. 6 and 8. Fibrils 660 also extend outwardly from the end zones 640 of the piles 610, similar to the fibrils 460 and 560 on the piles 410 and 510 of FIGS. 6 and 8.

It is believed that the disturbances and fibrils on the ends of the pile in the present invention help reduce the "sticky" feel associated with the prior art pile fabrics. Additionally, the present invention reduces the entanglement associated with "hooks" created by the expanded ends of the prior art piles.

Although the present invention has been described in considerable detail with reference to certain preferred embodiments, other versions are possible. Therefore, the spirit and scope of the appended claims should not be limited to the detailed descriptions of the preferred embodiments contained herein.

What is claimed is:

1. A fabric having a face side comprising pile fibers having a free length between a proximal end and a distal end, at least a portion of said pile fibers having surface abrasions extending from said distal end towards said proximal end, wherein said surface abrasion are disposed from about 2% to about 90% of said free length of said pile fibers.

2. The fabric according to claim 1, further including fibrils extending from the distal end.

3. The fabric according to claim 2, wherein the pile fiber comprises a thermoplastic.

4. The fabric according to claim 2, wherein the pile fibers further include sidewalls between the proximal end and the distal end, and where in the pile fibers further include fibrils extending from the side walls.

5. The fabric according to claim 4, wherein the pile fiber comprises a thermoplastic.

6. The fabric according to claim 1, wherein the pile fibers further include sidewalls between the proximal end and the distal end, and where in the pile fibers further include fibrils extending from the side walls.

7. The fabric according to claim 6, wherein the pile fiber comprises a thermoplastic.

8. A fabric having a face side comprising pile fibers having a free length between a proximal end and a distal end, at least a portion of said pile fibers having surface abrasions extending from said distal end towards said proximal end, wherein said surface abrasions are disposed from about 5% to about 50% of said free length of said pile fibers.

9. The fabric according to claim 8, further including fibrils extending from the distal end.

10. The fabric according to claim 9, wherein the pile fiber comprises a thermoplastic.

11. The fabric according to claim 9, wherein the pile fibers further include sidewalls between the proximal end and the distal end, and where in the pile fibers further include fibrils extending from the side walls.

12. The fabric according to claim 11, wherein the pile fiber comprises a thermoplastic.

13. The fabric according to claim 8, wherein the pile fibers further include sidewalls between the proximal end and the distal end, and where in the pile fibers further include fibrils extending from the side walls.

14. The fabric according to claim 13, wherein the pile fiber comprises a thermoplastic.

* * * * *